US006024680A

United States Patent [19]

Thompson, II

[11] Patent Number: 6,024,680

[45] Date of Patent: Feb. 15, 2000

[54] LEG EXERCISING DEVICE

[76] Inventor: Cleveland T. Thompson, II, P.O. Box 2211, Missouri City, Tex. 77459-9211

[21] Appl. No.: 09/137,042

[22] Filed: Aug. 20, 1998

[51] Int. Cl.[7] ..... A63B 22/14

[52] U.S. Cl. ..... 482/146; 482/70; 482/79; 482/80; 482/147

[58] Field of Search ..... 482/146, 147, 482/79, 80, 70, 71

[56] References Cited

U.S. PATENT DOCUMENTS

| | | | |
|---|---|---|---|
| 1,531,670 | 3/1925 | Levy | 482/79 |
| 4,653,749 | 3/1987 | Rorabaugh | 272/97 |
| 4,911,430 | 3/1990 | Flament | 272/97 |
| 4,979,731 | 12/1990 | Hermelin | 272/70 |
| 5,195,935 | 3/1993 | Fencel | 482/70 |
| 5,403,256 | 4/1995 | Squires | 482/91 |
| 5,417,630 | 5/1995 | Schulz | 482/70 |
| 5,503,609 | 4/1996 | Bull | 482/70 |
| 5,697,870 | 12/1997 | Osborn | 482/52 |

*Primary Examiner*—Richard J. Apley
*Assistant Examiner*—Tam Nguyen

[57] ABSTRACT

A therapeutic apparatus is provided including a base having a bottom plate and a plurality of top plates. A top surface of the bottom plate is equipped with a plurality of recessed channels formed therein. The plurality of top plates are mounted to the top surface of the bottom plate. A rotating foot mount is provided. A carriage assembly is mounted to a bottom end of a cylindrical post of the rotating foot mount. The housing of the carriage assembly is slidably situated within one of the recessed channels of the base. A spherical ball of the carriage assembly is rollable within the recessed channels. The cylindrical post of the rotating foot mount extends upwardly above the base. The rotating foot mount is slidable along the recessed channels of the base. A plurality of stopper assemblies are each situated at an intersection of the recessed channels. A shaft of each of the stopper assemblies is movable to a raised orientation for blocking the corresponding recessed channel. In such raised orientation, the shaft prevents movement of the rotating foot mount and carriage assembly within the recessed channels.

11 Claims, 8 Drawing Sheets

FIG. 3
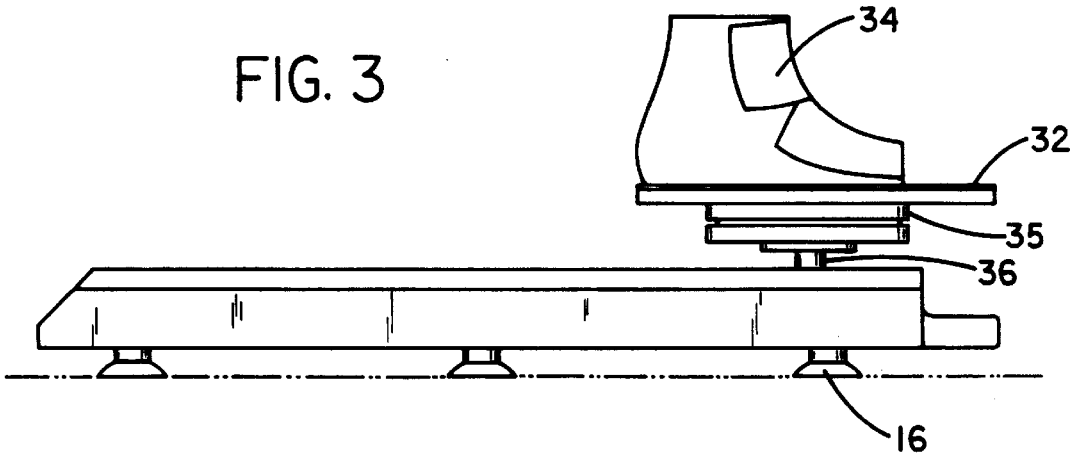
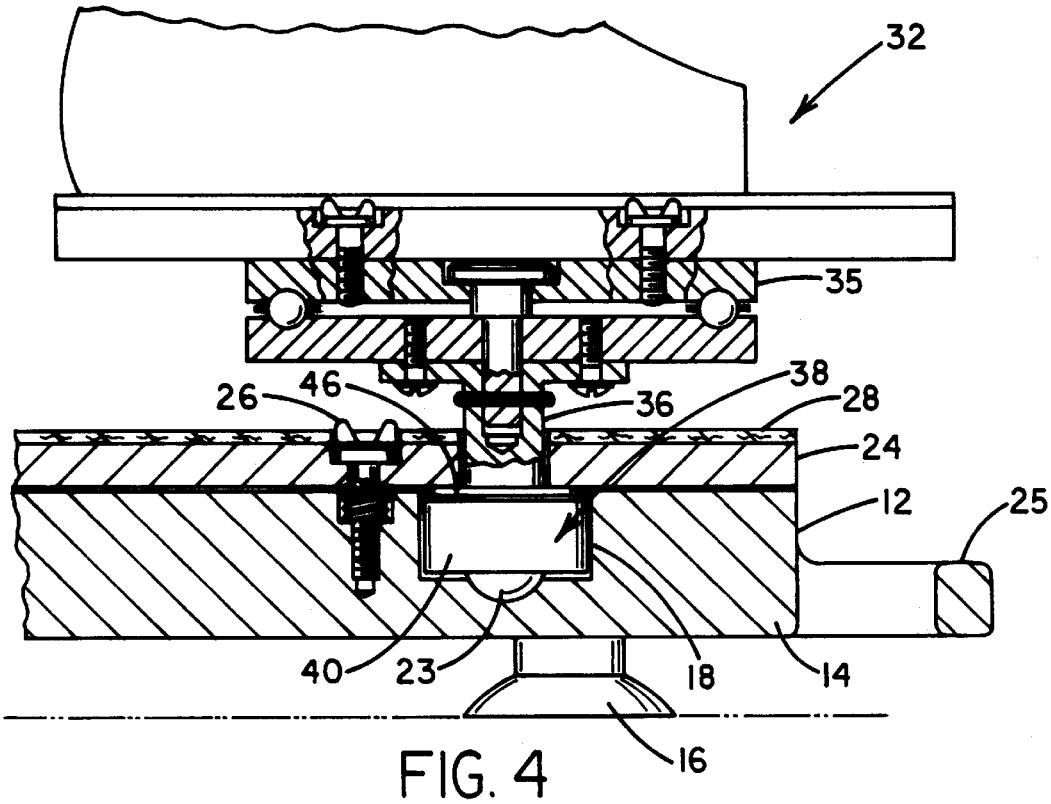
FIG. 4

LEG EXERCISING DEVICE

BACKGROUND OF THE INVENTION

1. Field of the Invention

The present invention relates to exercise devices and more particularly pertains to a new leg exercising device for rehabilitating or exercising leg muscles of a user.

2. Description of the Prior Art

The use of exercise devices is known in the prior art. More specifically, exercise devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise devices include U.S. Pat. No. 5,256,119; U.S. Pat. No. 4,909,505; U.S. Pat. Des. 301,619; U.S. Pat. No. 4,478,213; U.S. Pat. No. 4,402,502; and U.S. Pat. No. 4,846,156.

In these respects, the leg exercising device according to the present invention substantially departs from the conventional concepts and designs of the prior art, and in so doing provides an apparatus primarily developed for the purpose of rehabilitating or exercising leg muscles of a user.

SUMMARY OF THE INVENTION

In view of the foregoing disadvantages inherent in the known types of exercise devices now present in the prior art, the present invention provides a new leg exercising device construction wherein the same can be utilized for rehabilitating or exercising leg muscles of a user.

The general purpose of the present invention, which will be described subsequently in greater detail, is to provide a new leg exercising device apparatus and method which has many of the advantages of the exercise devices mentioned heretofore and many novel features that result in a new leg exercising device which is not anticipated, rendered obvious, suggested, or even implied by any of the prior art exercise devices, either alone or in any combination thereof.

To attain this, the present invention generally comprises a base with a periphery defined by a short linear rear edge, an arcuate front edge, and a pair of tapering side edges. As shown in FIGS. 4 & 7, the base includes a bottom plate having a bottom surface with a plurality of suction cups mounted thereon. Such suction cups are adapted for being secured to a recipient surface. A top surface of the bottom plate is equipped with a plurality of recessed channels formed therein. As shown in FIG. 1, the recessed channels include a peripheral channel and a cross channel in communication therewith. A bottom surface of each recessed channel has an arcuate gutter along a central extent thereof. The base further includes a plurality of top plates each mounted on the top surface of the bottom plate via spring biased bolts. It is important that each of the bolts have a winged top for gripping purposes. As shown in FIGS. 5 & 8, peripheral edges of the top plates extend over portions of the recessed channels. Further, a fabric material lines an upper surface of the top plate. As shown in FIG. 1, the top plates each have a cut out formed therein with an associated lid. Such a lid is adapted for allowing access to storage compartments formed in the bottom plate of the base between the recessed channels. For facilitating the opening of the lids, a semicircular cut out is formed on a periphery of the lids. With reference now to FIG. 4, a rotating foot mount is provided including a generally circular top plate. A pair of adjacent foot holsters are positioned on the top plate. A pair of sub plates coupled together in a manner so as to revolve with respect to each other, with an upper sub plate portion mounted to the top plate. A lower sub plate of the pair of sub plates is rotatable with respect to the upper portion and is further equipped with a cylindrical post coupled thereto and depending therefrom. The top plate and foot holsters of the rotating foot mount are adapted to rotate about a vertical axis. With reference still to FIG. 4, a carriage assembly includes a disk-shaped housing mounted to a bottom end of the cylindrical post of the rotating foot mount. A hemispherical recess is formed in a lower surface of the housing. Rotatably coupled within the hemispherical recess of the housing is a spherical ball with a bearing assembly situated therebetween. As shown in FIG. 5, an annular anti-friction bushing lines an upper surface of the housing. In use, the housing of the carriage assembly is slidably situated within one of the recessed channels of the base. As shown in FIG. 5, the spherical ball is rollable within the gutter and the anti-friction bushing remains in sliding abutment with a bottom surface of the top plates of the base. As such, the cylindrical post of the rotating foot mount extends upwardly above the base. By this structure, the rotating foot mount is slidable along the recessed channels of the base. As shown in FIG. 2, a plurality of stopper assemblies are each situated at an intersection of the recessed channels. Each stopper assembly includes a vertically oriented bore formed in the bottom plate of the base at one of said intersections, as shown in FIGS. 8 & 9. Each stopper assembly further includes a shaft having an indentation formed in a top end thereof and a disk-shaped handle mounted on a bottom end thereof. A spring biased ball bearing is positioned on a side wall of the shaft for releasably engaging a pair of indents formed in the bore. In operation, the shaft is movable to a lowered orientation with the indentation being flush with the gutter of the associated recessed channel. The shaft is further movable to a raised orientation for blocking the corresponding recessed channel. In such raised orientation, the shaft constrains movement of the rotating foot mount and carriage assembly within the recessed channels.

There has thus been outlined, rather broadly, the more important features of the invention in order that the detailed description that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the concept, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new leg exercising device apparatus and method which has many of the advantages of the exercise devices mentioned heretofore and many novel features that result in a new leg exercising device which is not anticipated, rendered obvious, suggested, or even implied by any of the prior art exercise devices, either alone or in any combination thereof.

It is another object of the present invention to provide a new leg exercising device which may be easily and efficiently manufactured and marketed.

It is a further object of the present invention to provide a new leg exercising device which is of a durable and reliable construction.

An even further object of the present invention is to provide a new leg exercising device which is inexpensive to manufacture with regard to both materials and labor, and which accordingly is then marketable at a low price to the consuming public, thereby making such leg exercising device economically available to the buying public.

Still yet another object of the present invention is to provide a new leg exercising device which provides in the apparatuses and methods of the prior art some of the advantages thereof, while simultaneously overcoming some of the disadvantages normally associated therewith.

Still another object of the present invention is to provide a new leg exercising device for rehabilitating or exercising leg muscles of a user.

Even still another object of the present invention is to provide a new leg exercising device that includes a base with at least one recessed channel formed therein. Also included is a foot mount slidable within the recessed channel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the present invention.

FIG. 4 is a side cross-sectional view of the present invention showing the foot mount, carriage assembly and base thereof.

DESCRIPTION OF THE PREFERRED EMBODIMENT

Figure 1:
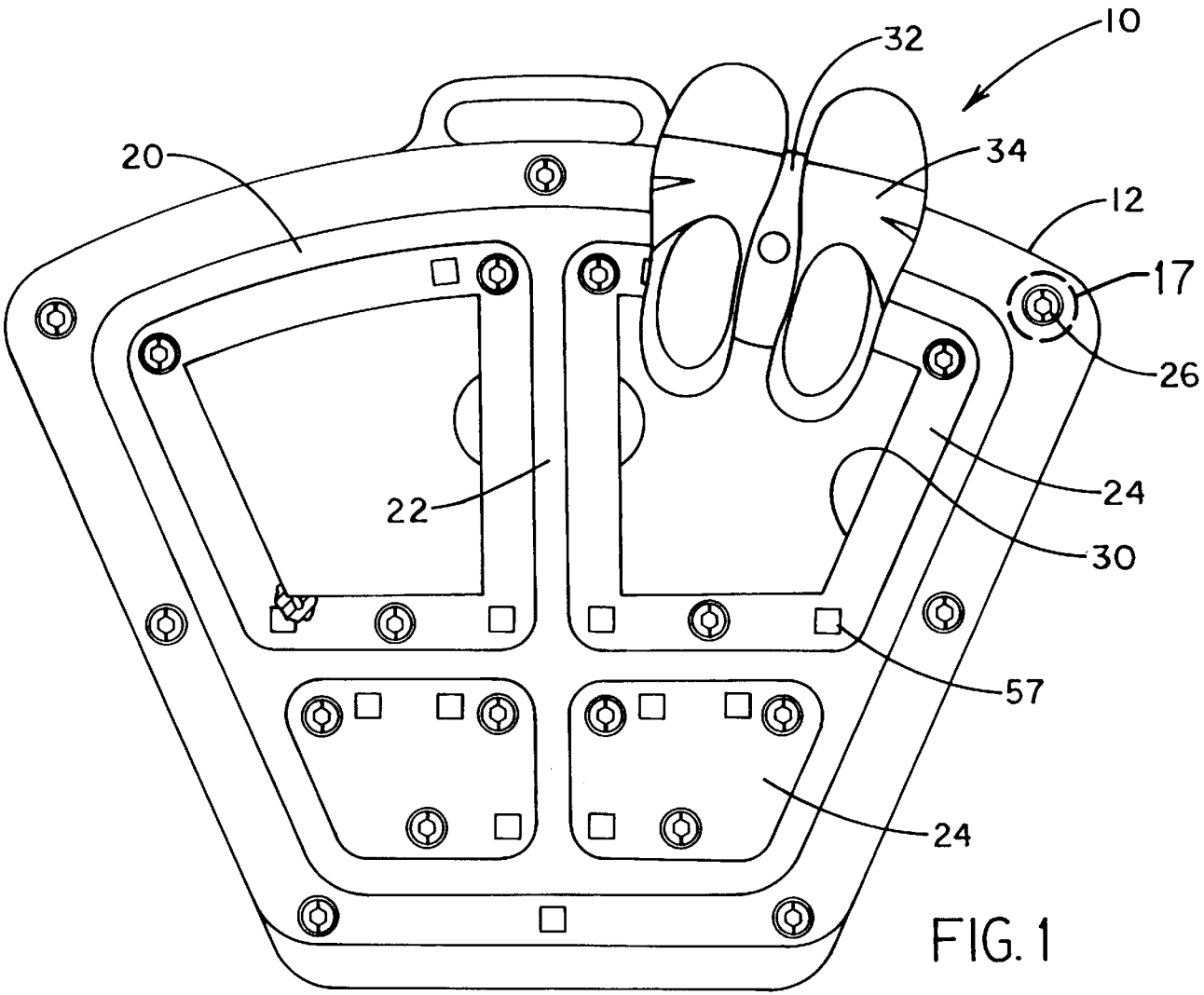
FIG. 1 is a top view of a new leg exercising device according to the present invention.
Figure 2:
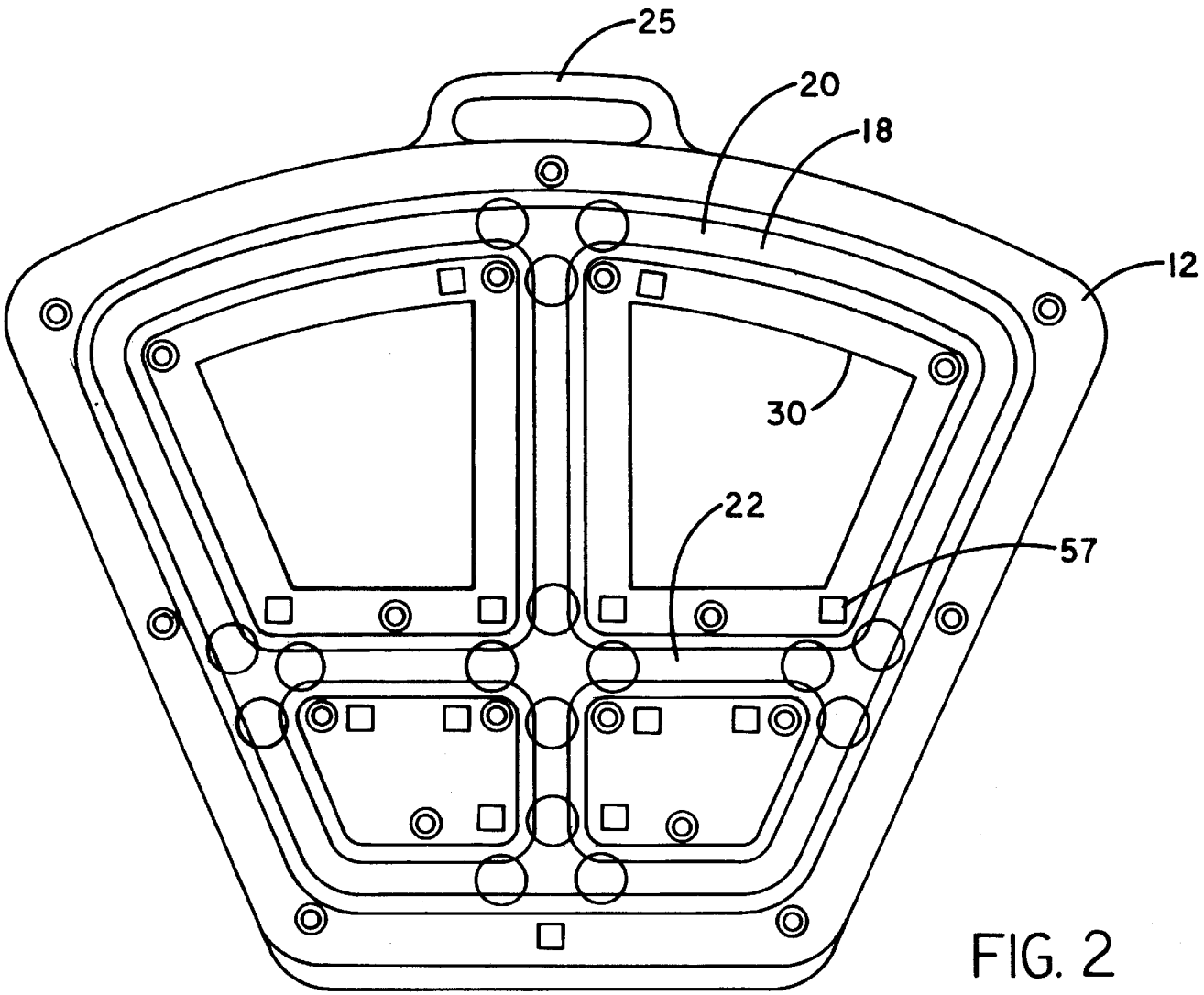
FIG. 2 is a top view of the present inventions showing the location of the stopper assemblies.

With reference now to the drawings, and in particular to FIGS. 1 through 18 thereof, a new leg exercising device embodying the principles and concepts of the present invention and generally designated by the reference numeral 10 will be described.

Figure 7:
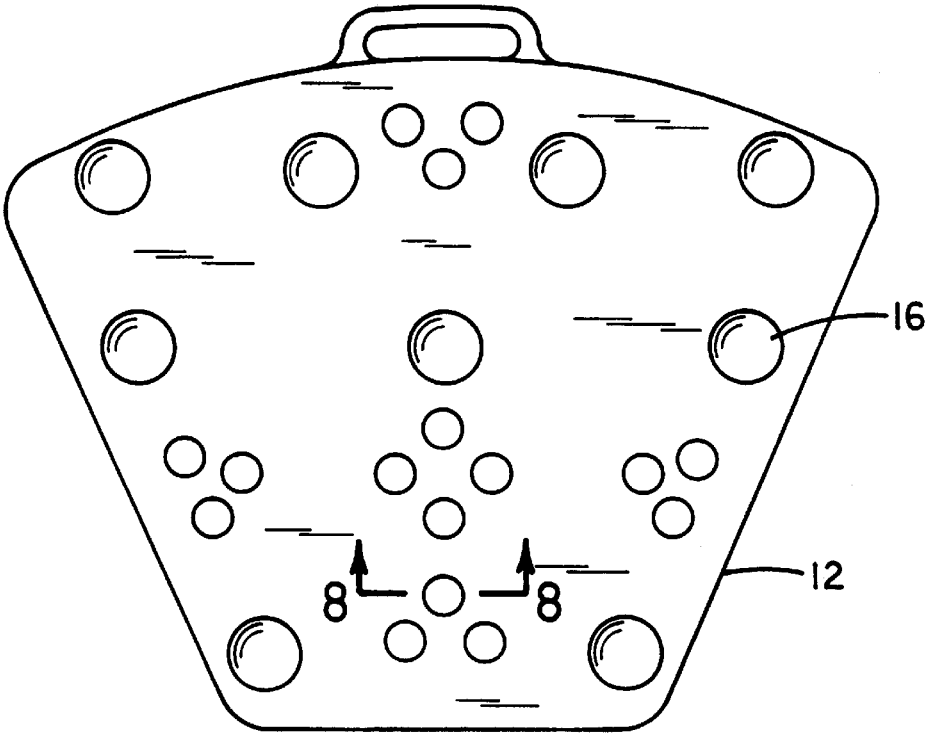
FIG. 7 is a bottom view of the present invention.
Figure 14:
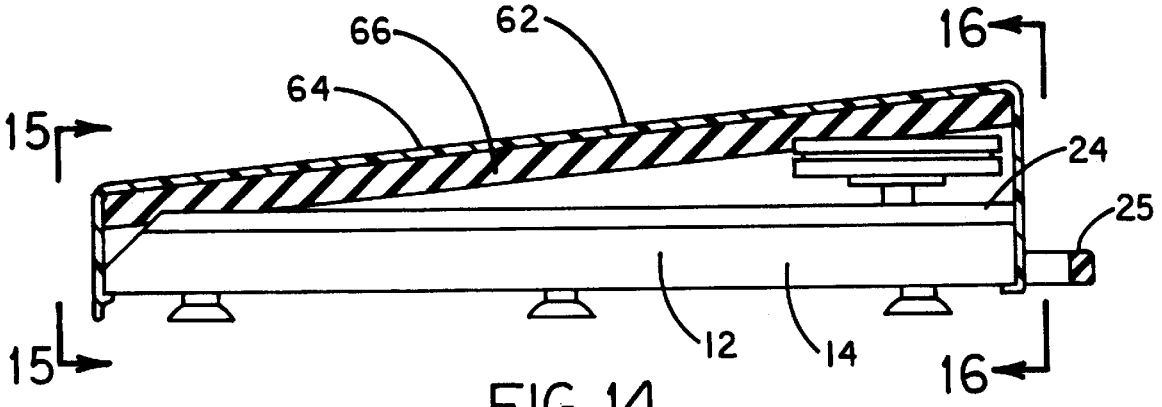
FIG. 14 is a side cross-sectional view of the cover of the present invention.

The present invention, designated as numeral 10, includes a base 12 with a periphery defined by a short linear rear edge, an arcuate front edge, and a pair of tapering side edges. As shown in FIGS. 4 & 7, the base includes a bottom plate 14 having a bottom surface with a plurality of suction cups 16 mounted thereon. Such suction cups are adapted for being secured to a recipient surface. A top surface of the bottom plate is equipped with a plurality of recessed channels 18 formed therein. As shown in FIG. 1, the recessed channels include a peripheral channel 20 and a cross channel 22 in communication therewith. A bottom surface of each recessed channel has an arcuate gutter 23 along a central extent thereof. Note FIG. 5. As shown in FIG. 14, a handle 25 is preferably attached to the arcuate front edge of the bottom plate of the base for carrying purposes.

Figure 5:
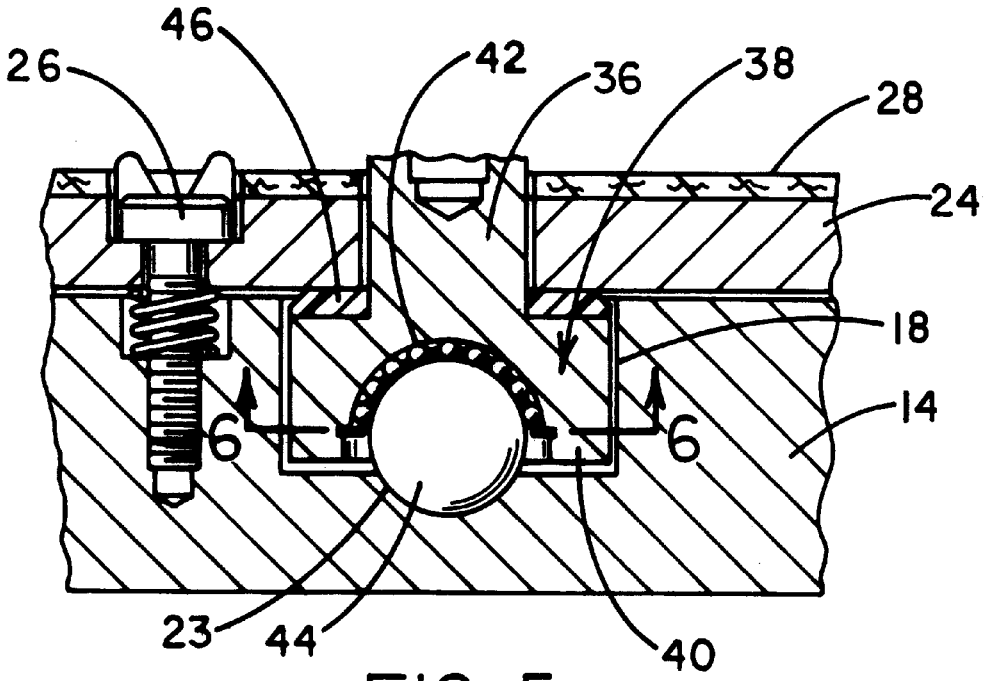
FIG. 5 is a detailed side cross-sectional view of the carriage assembly of the present invention.
Figure 6:
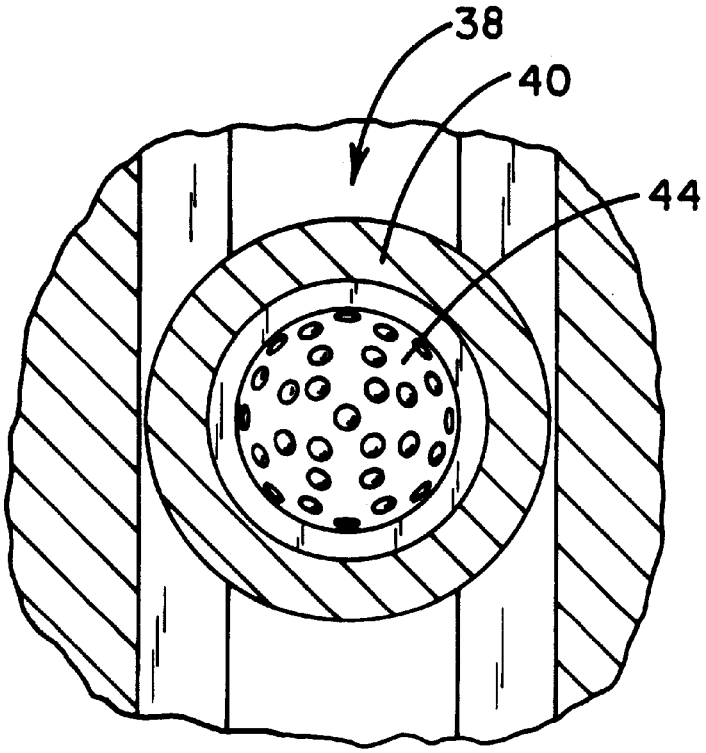
FIG. 6 is a cross-sectional view of the present invention taken along line 6—6 shown in FIG. 5.
Figure 8:
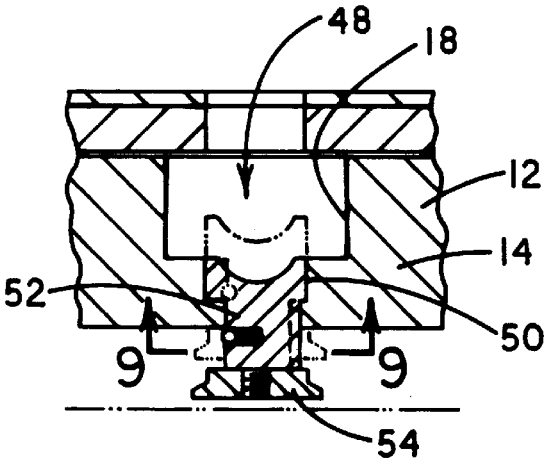
FIG. 8 is a cross-sectional view of one of the stopper assemblies of the present invention.

The base further includes a plurality of top plates 24 each mounted on the top surface of the bottom plate via spring biased bolts 26. Note FIG. 5. It is important that each of the bolts have a winged top for gripping purposes. Further, each bolt preferably has a gauge for indicating an amount of force that is present between the top and bottom plates. See FIG. 17. As shown in FIGS. 5 & 8, peripheral edges of the top plates extend over portions of the recessed channels. Further, a fabric material 28 lines an upper surface of the top plate.

As shown in FIG. 1, at least two of the top plates each have a cut out 30 formed therein with an associated lid. Such a lid is adapted for allowing access to storage compartments formed in the bottom plate of the base between the recessed channels. For facilitating the opening of the lids, a semicircular depression is formed on a periphery of the lids. The storage compartments are critical for housing various tools which may be used to adjust or repair the present invention.

With reference now to FIG. 4, a rotating foot mount 32 is provided including a generally circular top plate. A pair of adjacent flexible foot holsters 34, or boots, are positioned on the top plate. Velcro or any other type of fastening mechanism may be employed for securing feet of a user to the foot mount. A pair 35 of sub plates have an upper sub plate mounted to the top plate. A lower sub plate of the pair of sub plates is rotatable with respect to the upper sub plate—lower and is further equipped with a cylindrical post 36 coupled thereto and depending therefrom. The top plate and foot holsters of the rotating foot mount are thus adapted to rotate about a vertical axis.

With reference still to FIG. 4, a carriage assembly 38 includes a disk-shaped housing 40 mounted to a bottom end of the cylindrical post of the rotating foot mount. A hemispherical recess 42 is formed in a lower surface of the housing. Rotatably coupled within the hemispherical recess of the housing is a spherical ball 44 with a bearing assembly situated therebetween. As shown in FIG. 5, an annular anti-friction bushing 46 lines an upper surface of the housing.

In use, the housing of the carriage assembly is slidably situated within one of the recessed channels of the base. As shown in FIG. 5, the spherical ball is rollable within the gutter and the anti-friction bushing remains in sliding abutment with a bottom surface of the top plates of the base. As such, the cylindrical post of the rotating foot mount extends upwardly above the base. By this structure, the rotating foot mount is slidable along the recessed channels of the base.

Figure 9:
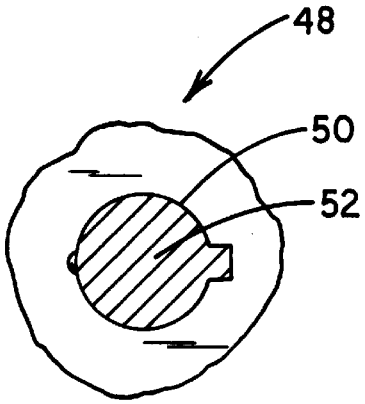
FIG. 9 is a cross-sectional view of the stopper assembly of FIG. 8 taken along line 9—9 of FIG. 8.
Figure 10:
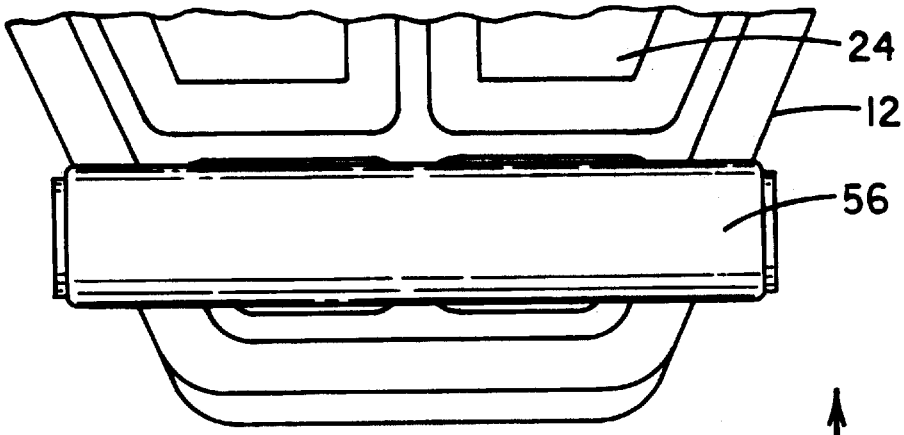
FIG. 10 is a top view of the cross bar of the present invention.
Figure 11:
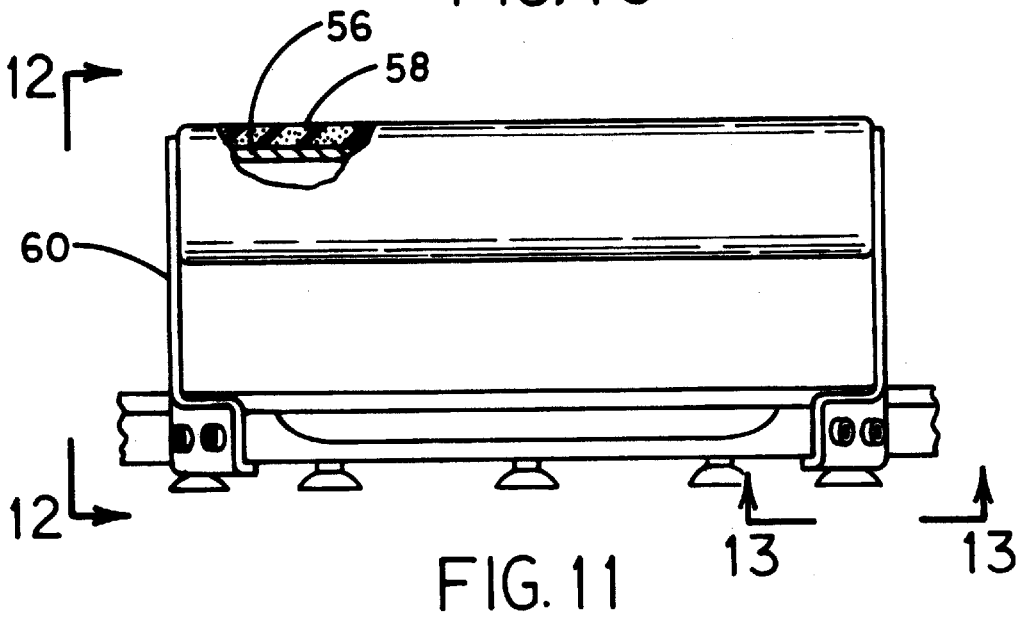
FIG. 11 is a rear view of the cross bar of the present invention.
Figure 12:
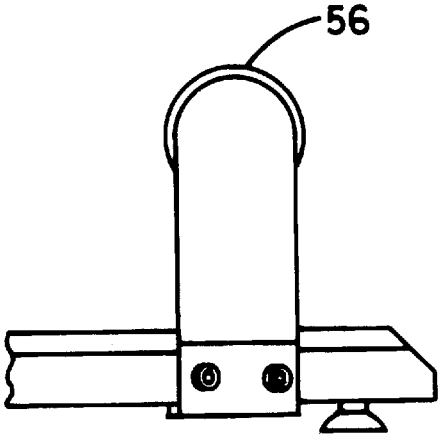
FIG. 12 is a side view of the cross bar of the present invention.
Figure 13:
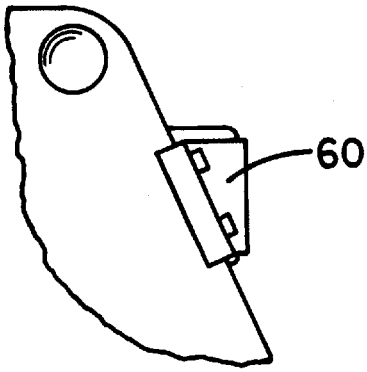
FIG. 13 is a bottom view of the cross bar of the present invention.

A plurality of stopper assemblies 48 are each situated at an intersection of the recessed channels. Each stopper assembly is located at a vertically oriented bore 50 formed in the bottom plate of the base at one of said intersections, as shown in FIGS. 8 & 9. Each stopper assembly further includes a shaft 52 having an indentation formed in a top end thereof and a disk-shaped handle 54 mounted on a bottom end thereof. A spring biased ball bearing is positioned on a side wall of the shaft for releasably engaging a pair of indents formed in the bore. As an option, cut outs 57 may be formed in the top plates for manipulating the stopper assemblies from above the base.

In operation, the shaft is movable by the user to a lowered orientation with the indentation being flush with the gutter of the associated recessed channel. The shaft is further movable to a raised orientation for blocking the corresponding recessed channel. In such a raised orientation, the shaft constrains movement of the rotating foot mount and carriage assembly within the recessed channels.

As shown in FIGS. 10–13, a removable cross bar 56 includes a cylindrical member and a pad 58 lining an exterior surface of the cylindrical member. A pair of stanchions 60 each has a top end coupled to one end of the cylindrical member. A bottom end of each stanchion is beveled for removably coupling with one of the tapering side edges of the base via a pair of screws. Slits may be formed in the base for removably receiving the stanchions.

Figure 15:
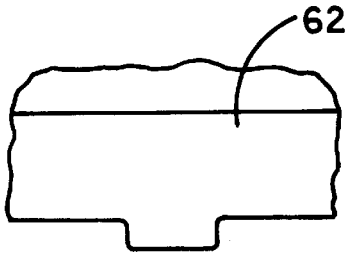
FIG. 15 is a front view of the cover of the present invention.
Figure 16:
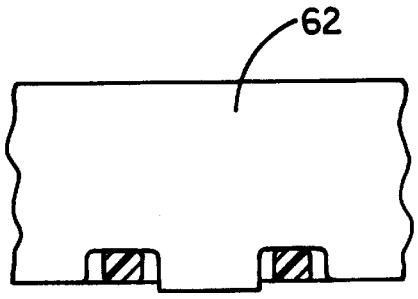
FIG. 16 is a rear view of the cover of the present invention.
Figure 17:
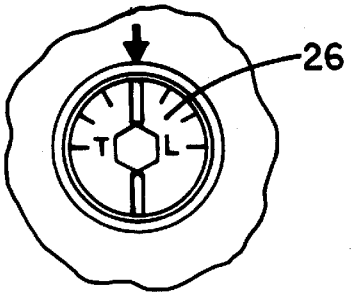
FIG. 17 is a top view of one of the bolts of the base of the present invention shown in FIG. 1.
Figure 18:
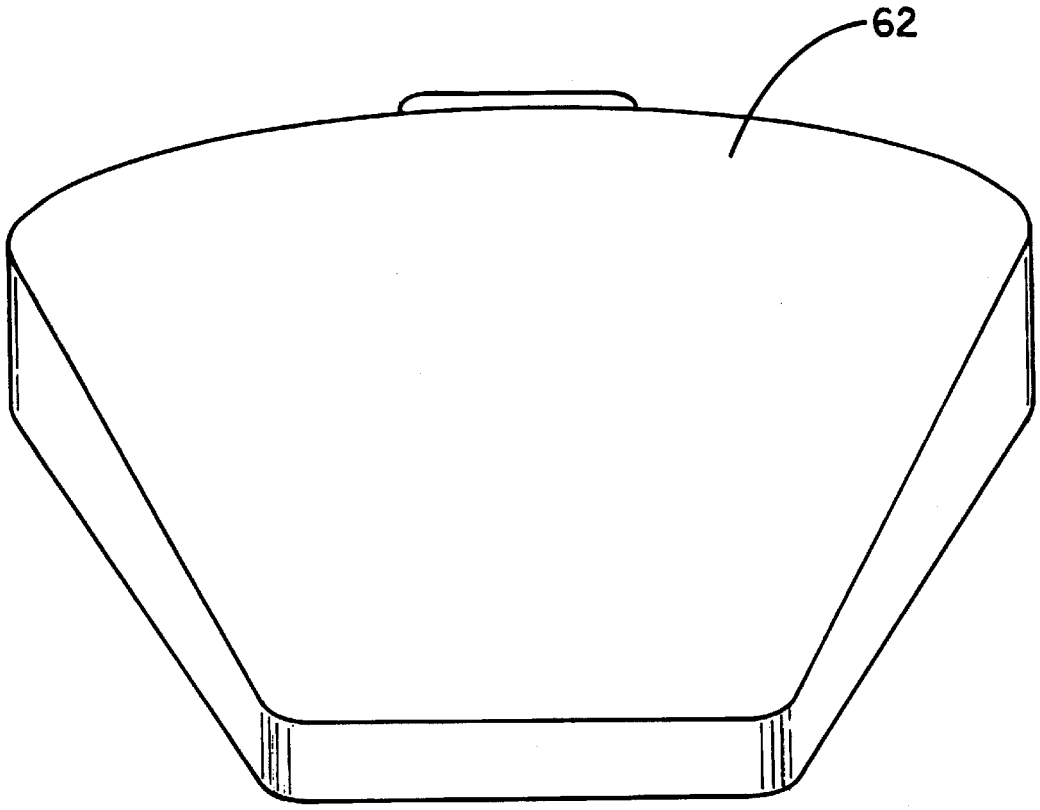
FIG. 18 is a top view of the cover of the present invention.

As shown in FIGS. 14–16, a cover 62 is provided including a plastic outer layer 64 having a top face with a periphery equipped with a shape similar to that of the base. A peripheral lip of the outer layer of the cover is coupled to the periphery of the top face and extends downwardly therefrom for defining a lower peripheral edge. Such a lower peripheral edge has an inwardly extending flange for snappily engaging the base. As shown in FIG. 18, the peripheral lip of the cover is preferably tapered. As shown in FIG. 14, the cover further includes an inner layer 66 constructed from foam which lines an underside of the outer layer.

In use, a user lies supine on the floor and the feet of the user may be secured within the foot holster such that the base now has a generally vertical orientation. The foot holster is then maneuvered along a predetermined path defined by the recessed channels. This may also be done by changing the amount of desired friction by increasing or decreasing the distance between the top plates and the bottom plates by turning the spring biased bolts such that the friction between the spherical ball and the gutter is varied. The cross bar may be used for supporting a user during use of the present invention, such as by gripping the pad 58 on the exterior of the cross bar. After use, the cover may be placed over the base to protect the same.

The present invention thus constitutes a neuromuscular strengthening device designed to develop proprioceptive and kinesthetic sensory of transitional acute hemiplegic and hemiparesis patients. The present invention accomplishes this by targeting the muscle groups of the lower extremities with some lower trunk muscular motion interaction. To use, the user lies supine adjacent to the board. An unillustrated thigh strap may optionally be used to secure the strengthening device below the knees. The user then moves the affected limb by using the unaffected limb along the predefined pathways of the base. The present invention may also be used as an exercise device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A therapeutic apparatus comprising, in combination:

a base with a periphery defined by a short linear rear edge, an arcuate front edge, and a pair of tapering side edges, the base including a bottom plate having a bottom surface with a plurality of suction cups mounted thereon for being secured to a recipient surface and a top surface with a plurality of recessed channels formed therein including a peripheral channel and a cross channel in communication therewith wherein a bottom surface of each recessed channel has an arcuate gutter along a central extent thereof, a plurality of top plates each mounted on the top surface of the bottom plate via spring biased bolts such that peripheral edges thereof extend over portions of the recessed channels with each of the bolts having a winged top for gripping purposes, and a fabric material lining an upper surface of the top plate;

said two of the top plates having a cut out formed therein with an associated lid for allowing access to storage compartments formed in the bottom plate of the base between the recessed channels;

a rotating foot mount including a generally circular top plate with a pair of adjacent foot holsters positioned thereon, a pair of sub plates coupled together in a manner so as to revolve one subplate relative to the other subplate, the pair of subplates having an upper subplate mounted to the top plate and a lower subplate rotatable with respect to the upper subplate and equipped with a cylindrical post coupled thereto and depending therefrom, wherein the top plate and foot holsters are adapted to rotate about a vertical axis;

a carriage assembly including a disk-shaped housing mounted to a bottom end of the cylindrical post of the rotating foot mount, a hemispherical recess formed in a lower surface of the housing, a spherical ball rotatably coupled within the hemispherical recess with a bearing assembly situated therebetween, and an annular anti-friction bushing lining an upper surface of the housing, wherein the housing is slidably situated within one of the recessed channels of the base with the spherical ball rollable within the gutter and the anti-friction bushing is in sliding abutment with a bottom surface of the top plates of the base such that the cylindrical post of the rotating foot mount extends upwardly above the base, whereby the rotating foot mount is slidable along the recessed channels of the base;

a plurality of stopper assemblies each situated at an intersection of the recessed channels, each stopper assembly including a vertically oriented bore formed in the bottom plate of the base at one of said intersections, a shaft having an indentation formed in a top end thereof and a disk-shaped handle mounted on a bottom end thereof, and a spring biased ball bearing mounted on a side wall of the shaft for releasably engaging a pair of indents formed in the bore, wherein the shaft is movable between a lowered orientation with the indentation being flush with the gutter of the associated recessed channel and a raised orientation for blocking the corresponding recessed channel for preventing movement of the rotating foot mount and carriage assembly within the recessed channels;

a removable cross bar including a cylindrical member, a pad lining an exterior surface of the cylindrical member and a pair of stanchions each having a top end coupled to one end of the cylindrical member and a bottom end being beveled for removably coupling with the tapering side edges of the base via a pair of screws; and a cover including a plastic outer layer having a top face with a periphery equipped with a shape similar to that of the base and a peripheral lip coupled to the periphery of the top face and depending downwardly therefrom for defining a lower peripheral edge having an inwardly extending flange for snappily engaging the base, the cover further including an inner layer constructed from foam and lining an underside of the outer layer.

2. A therapeutic apparatus for attaching to the feet of a user, the therapeutic apparatus comprising:

a base with at least one recessed channel formed therein;

a foot mount; and a carriage assembly mounted to the foot mount and slidable within the recessed channel, a top plate and a bottom plate of the base being for constraining the carriage assembly, the top and bottom plates being tightenable together for providing a degree of resistance against the motion of the carriage assembly of the foot mount against the recessed channel of the base.

3. A therapeutic apparatus as set forth in claim 2 wherein the base has a plurality of suction cups mounted thereon for securing to a recipient surface.

4. A therapeutic apparatus as set forth in claim 2 wherein the foot mount is rotatable about a vertical axis.

5. A therapeutic apparatus as set forth in claim 2 wherein the foot mount has at least one foot holster mounted thereon.

6. A therapeutic apparatus as set forth in claim 2 wherein a plurality of variously configured recessed channels are included along with stoppers for selectively preventing motion of the carriage within selected channels.

7. A therapeutic apparatus as set forth in claim 2 wherein an elevated cross bar is mounted on the base, the cross bar extending over the top plates.

8. A therapeutic apparatus as set forth in claim 7 wherein the cross bar is removable.

9. A therapeutic apparatus as set forth in claim 2 wherein a plurality of storage compartments are formed in the base.

10. A therapeutic apparatus as set forth in claim 2 wherein a cover is removably secured on the base.

11. A therapeutic apparatus as set forth in claim 2 wherein the base has a handle.

* * * * *